US006745529B2

(12) United States Patent
Beltran

(10) Patent No.: US 6,745,529 B2
(45) Date of Patent: Jun. 8, 2004

(54) POLE ANCHOR FOR DECKING OR GROUND SUPPORT

(76) Inventor: Juan J. Beltran, 120 W. 223rd St. #14, Carson, CA (US) 90745

( * ) Notice: Subject to any disclaimer, the term of this patent is extended or adjusted under 35 U.S.C. 154(b) by 177 days.

(21) Appl. No.: 10/042,681

(22) Filed: Jan. 11, 2002

(65) Prior Publication Data

US 2002/0062620 A1 May 30, 2002

Related U.S. Application Data

(60) Provisional application No. 60/225,856, filed on Aug. 17, 2000.

(51) Int. Cl.[7] ..... E02D 27/32

(52) U.S. Cl. ..... 52/297; 52/298; 411/180; 256/65.14; 256/65.01; 248/529

(58) Field of Search ..... 411/180, 82, 82.1; 52/103, 721.1, 297, 298; 256/65.14, 59, 65.01, 1, 19, 21; 248/529, 910

(56) References Cited

U.S. PATENT DOCUMENTS 3,279,133 A * 10/1966 De Korte ..... 52/103
3,709,188 A * 1/1973 Coupar ..... 52/163
4,269,534 A * 5/1981 Ryan ..... 404/10
4,480,819 A * 11/1984 Lopez ..... 256/1
4,926,785 A * 5/1990 Lamson ..... 116/209
5,090,348 A * 2/1992 Hugron ..... 116/63 P
5,354,031 A * 10/1994 Bilotti ..... 248/519
5,363,607 A * 11/1994 Turturro ..... 52/40
5,485,700 A * 1/1996 Van Vranken ..... 52/40
6,135,424 A * 10/2000 Bracke ..... 256/59
6,279,880 B1 * 8/2001 Hawks, Jr. ..... 256/67
6,536,369 B1 * 3/2003 Bent et al. ..... 116/63 P
6,584,658 B2 * 7/2003 Robinson ..... 27/1

* cited by examiner

*Primary Examiner*—Carl D. Friedman
*Assistant Examiner*—Nahid Amiri
(74) *Attorney, Agent, or Firm*—Roger A. Marrs

(57) ABSTRACT

A pole anchor installation having an anchor base with a central threaded open-ended hole mounted in a receptacle formed in a planking or concrete of a deck. An elongated sleeve having external threads is threadably fitted into the threaded opening of the anchor base so that the sleeve upwardly projects to insertably receive a substantial portion of a pole intended to be supported. A threaded blockage plug is received in the threaded opening of the anchor base when the sleeve and pole are not employed preventing clogging of the threaded opening. In a wood foundation, angular threaded bores are provided into which mounting screws are placed to secure the anchor base. In a concrete block or cement slab, reinforcing rods are carried on the underside of the anchor base and are embedded within the material of the block or slab. In either type of installation, the top surface of the support anchor base is flush with the surrounding surface of either the wood planking or the cement block or cement slab.

3 Claims, 1 Drawing Sheet

10
11
12
13
14
15
16
17
18
20
21
22
23
24
25
26
27
30
31
32
33
34
35
36
2
9

POLE ANCHOR FOR DECKING OR GROUND SUPPORT

This application claims benefit of provisional application 60/225,856 filed Aug. 17, 2000.

BACKGROUND OF THE INVENTION

1. Field of the Invention

The present invention relates to the field of pole supports which may be removably placed into an anchor fitting for use with a wood decking, concrete slab or foundation or for use in connection with ground support in a lawn or the like.

2. Brief Description of the Prior Art

In the past, it has been the conventional practice to support elongated poles, such as used to support an umbrella or a tennis netting or the like, by introducing the free end of the pole into a cement block having a central hole or by inserting the free end of the pole into a triangular support or, in the case of ground support, digging a hole into which the free end of the pole is introduced. In all of these prior situations, the pole anchor is either unsightly, inconvenient to move from place to place or requires digging so that the resultant pole is unsupported. Also, prior anchor installations leave an open hole into which debris, dirt or foreign matter can collect. Generally, in order to support the weight of a beach or lawn umbrella from such prior anchor installations, a substantial long support hole is necessary in order to receive and retain a substantial length of the pole. If a short hole is employed, substantial load forces are generated through the hole into the anchor installation so that pole breakage or even dislodgment of the pole from the installation results. For example, strong winds may capture an umbrella and cause the pole to break or to completely disconnect from the anchor installation.

Therefore, a long-standing need has existed to provide a pole support which retains a sufficient length of the pole so as to transfer load forces into the installation and which will provide a detachable plug or cover for the opening into the pole receiving hole of the installation when the pole is not in use. Such an installation should be suitable for mounting on a wooden deck, a concrete slab or in the ground of a lawn.

SUMMARY OF THE INVENTION

Accordingly, the above problems and difficulties are avoided by the present invention which provides a novel pole anchor installation which includes an anchor base having a central threaded open-ended hole. The anchor base may be mounted in a receptacle formed in the planking of a wood deck or may be installed in a concrete slab or cement block intended to be embedded in the ground. An elongated sleeve having an open-ended bore and having threads externally exposed at one end is employed that may be threadably fitted into the threaded opening of the anchor base so that the sleeve upwardly projects a sufficient distance in order to insertably receive within the bore a substantial portion or length of the pole intended to be supported. A feature of the invention resides in providing a threaded blockage plug adapted to be received in the threaded opening of the anchor base when the sleeve and pole are not employed. The plug prevents clogging of the threaded opening when the sleeve is not attached. Furthermore, in connection with installation of the anchor base in a wood foundation, angular threaded bores are provided in the anchor base into which mounting screws are placed in order to secure the anchor base in the wood foundation. However, when it is intended to support the anchor base in a cement block or on a concrete slab, reinforcing rods may be carried on the underside of the anchor base and are intended to be embedded within the cement of the block or slab. In either type of installation, the top surface of the support anchor base is flush with the surrounding surface of either the wood planking or the cement block or cement slab.

Therefore, it is among the primary objects of the present invention to provide a novel pole anchor for decking, ground support, concrete or cement block or the like, which includes a base having an open-ended threaded opening for threadably receiving a mating end of an elongated sleeve. The sleeve includes an internal bore open at one end in order to insertably receive the free end of a pole. The opposite end of the pole may carry an umbrella, a netting or any other apparatus. When the pole and sleeve are not in use, a threaded plug is removably disposed in the threaded opening of the anchor base to prevent debris from collecting inside the threaded opening.

The anchor base may include threaded bores which are angularly exposed in order to insertably receive threaded fasteners for connection to wood beams, planking or slats. For installations in concrete or cement, such as a block or slab, reinforcing rods may be threadably connected into threaded openings on the underside of the anchor base so as to downwardly project into the cement or concrete. A concrete block may then be placed into a pre-dug hole in the ground to complete an installation in a lawn.

Therefore, it is among the primary objects of the present invention to provide a novel anchor installation for an elongated pole which would normally support an umbrella, tennis netting, badminton netting, or the like.

Another object of the present invention is to provide a novel anchor support for an elongated pole that may be readily installed on a wooden porch, on a cement block installed in the dirt or that may be installed on a cement or concrete slab.

Yet another object of the present invention is to provide a novel support for an elongated pole which is intended to project upwardly to support an umbrella or the like whereby load forces encountered during use of the umbrella or the like will be suitably transferred and distributed from the pole through the anchoring installation into surrounding decking, cement slab or surrounding ground.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF PREFERRED EMBODIMENT

Figures 1, 2, 3, 4:
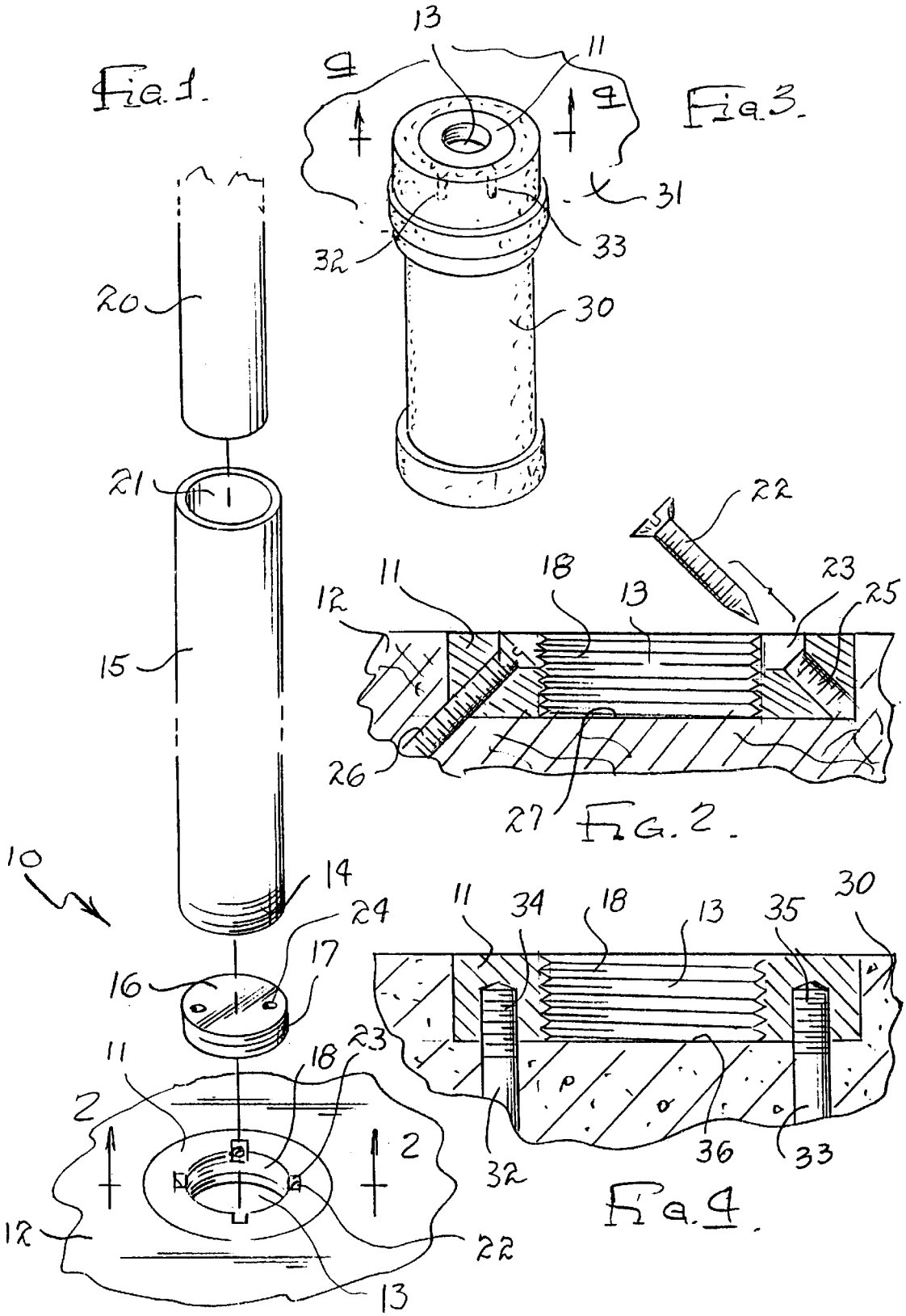
FIG. 1 is an exploded perspective view showing the inventive pole anchor for decking or other ground support in accordance with the present invention.
FIG. 2 is an enlarged cross-sectional view of the anchor base used in the installation shown in FIG. 1 as taken in the direction of arrows 3—3 thereof for use in connection with installation on a wooden deck or platform.
FIG. 3 is a reduced perspective view of another version of the invention wherein the anchor base is mounted on a cement block for subsequent installation into the ground surrounded by lawn.
FIG. 4 is an enlarged transverse cross-sectional view of the anchor base used in the installation shown in FIG. 3 as taken in the direction of arrows 4—4 thereof.

Referring to FIG. 1, the inventive pole anchor is illustrated in the general direction of arrow 10 which includes an anchor base 11 which, in this version, is installed on a wooden decking, indicated by numeral 12. The anchor base includes a central opening 13 which is threaded in order to threadably receive the external threads 14 carried on the lower end of a holding sleeve 15. Alternately, when the sleeve 15 is not installed on the anchor base 11, a closing plug 16 is employed to block the opening 13 so that dirt, debris or foreign matter cannot enter into the opening. The plug 16 includes external threads 17 which threadably engage with the internal threads 18 of the anchor base. However, when the closing plug 16 has been removed and the holding sleeve is installed on the anchor base 11, a pole 20 may be inserted into the open bore 21 of the sleeve 15. Thereby, the pole 20 is supported by the securement of the anchor base to the decking 12 and the fact that a substantial length of the pole 20 is supported by the length of the holding sleeve 15.

The pole 20 may be employed to support a lawn umbrella, netting for such things as tennis or badminton, or the pole may be employed for supporting any other type of load-bearing device or apparatus. It is to be particularly noted that the sleeve 15 extends substantially above the surface of the decking 12 and that the sleeve does not project beneath the surface in order to hold and support the lower portion of the pole 20. Thus, loads encountered by the pole 20 are distributed through the holding sleeve 15 and through the anchor base 11 into the surrounding decking.

The anchor base 11 is fixedly secured to the decking by means of a plurality of screw fasteners, such as indicated by numeral 22. At least four screws are employed and the edge of opening 13 leading into the opening is provided with notches, such as notch 23, in order to receive an associated screw. Furthermore, it is to be noted that the upper surface of the anchor base 11 is flush with the decking 12 so that once the closing plug 16 has been threadably engaged with opening 13 and rotated into its closing position, the anchoring support is completely flush with the decking surface and there is no projection extending above the decking surface. For ease in installing or removing the closing plug 16 from the threaded opening 13, slots or, as illustrated, a pair of detents or recesses are included which can be used for gripping purposes by an installation or removal tool. Such recesses are shown by numeral 24.

As illustrated in FIG. 2, the anchor base 11 is installed in a recess in decking 12 so that the upper surface of the anchor base is flush with the surface of the decking. Securement is effected by fasteners 22 which are inserted into associated notches 23 and are extended through a threaded bore 25 into gripping relationship with the wood decking. A completely secured and installed screw is identified by numeral 26 and it is noted that the head of the screw is tapered and fits into a chamfer so that the head of the screw is completely hidden within the respective notch 23. Furthermore, when the holding screw 15 has been fastened to the anchor base 11, and when the lower portion of pole 20 has been inserted through the bore 21 of the holding sleeve, the extreme free or bottom end of the pole rests and bears against the wood decking 12 by engaging with exposed surface 27. Therefore, load forces are not only distributed into the decking via the holding sleeve and the anchor base but directly from the pole to the decking via surface 27. A substantial portion of the weight of the pole and umbrella, netting or the like is directed into the decking through surface 27.

Referring now in detail to FIG. 3, another version of the invention is illustrated in which the anchor base 11 is mounted onto a cement block 30 which is buried in the ground and surrounded by a lawn 31. The opening 13 is threaded and receives the lower end of holding sleeve 15 in the same manner as previously described with respect to the embodiment shown in FIGS. 1 and 2. However, the anchor base 11 is secured to the cement or concrete block 30 by means of reinforcing studs or rods, such as indicated by numerals 32 and 33 respectively. Thus, the anchor base 11 and the supporting block 30 form a unitary construction and are handled as a single piece for installation into the ground. The ground is initially excavated to accept the length and diameter of the block 30 and the block is then placed into the evacuated hole so that the surface of the anchor base 11, top surface of the block 30 and the surrounding lawn 31 are flush and no projection extends beyond the surface of the lawn. It is also to be considered that the closing plug 16 is used to close the opening 13, as previously described with respect to embodiment shown in FIGS. 1 and 2 wherein the sleeve 15 is not used.

Referring now in detail to FIG. 4, it can be seen that the reinforcing rods 32 and 33 are initially threaded into bores carried on the underside of the anchor base 11. The threaded bores are carried on opposite sides of the opening 13 and as many rods are employed as necessary to effect securement. The threaded engagement of the terminating ends of rods 32 and 33 are indicated by numerals 34 and 35 respectively. The block 30 may be composed of any concrete, cement or other holding material. It is also to be understood that the support rods 32 and 33 may be placed directly into a cement slab or into a pavement material without the necessity of employing block 30. In such an instance, the anchor base 11 and the rods 32 and 33 are placed into uncured or wet cement or concrete followed by permitting the material to cure so that the anchor base and the rods are fixedly secured to the material. As set forth above, the closing plug 16 may be readily accepted into the threaded opening 13 when the sleeve 15 is not in use. The surface of the plug, the surface of the anchor base and the surface of the block or cement slab are flush so that there is no projection or upwardly extending portion of the installation which would interfere with mowing of a lawn or the playing of a game on pavement or the like.

In view of the foregoing, it can be seen that the pole support means of the present invention may be installed on a wood deck, in the ground surrounded by lawn or on a concrete slab or the like. The closing plug 16 prevents dirt or debris from entering into the threaded opening 13 and when not in use, the holding sleeve 16 may be readily installed without the use of special equipment or the like into the threaded opening 13. The lower end of pole 20 is inserted into the bore 21 of the holding sleeve and bears against the surface 27 of a wood deck, as shown in FIG. 2, or against the surface 36 of the cement block or slab. If desired, internal threads 40 on the end of pole 20 may be engaged with the internal threads 18 of recess or opening 13.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A pole anchor installation comprising:

an elongated pole having a lower section and an upper section;

a sleeve having an open-ended bore;

an anchor base having a central threaded recess and a flat top surface;

support means secured to said anchor base and having a surface underlying said threaded recess;

threaded means carried externally on said pole for detachable engagement with said threaded recess whereby said pole rests on said surface to distribute load forces into said support means;

a plug having a threaded portion engagable with said threaded recess in the absence of said sleeve;

reinforcement fasteners connecting said anchor base to said supporting means; and said supporting means includes an upper surface coextensive with and flush with said top flat surface of said anchor base.

2. The pole anchor installation defined in claim 1 including:

fastener recesses provided in an edge marginal region of said anchor base defining said threaded recess; and fasteners projecting through said anchor base via said fastener recesses into gripping engagement with said supporting means.

3. A pole support installation comprising:

an elongated pole having opposite ends with a selected end adapted to be supported and a non-selected end extending away from said selected end;

an anchor base having a threaded receptacle for detachably joining and connecting with said selected end of said pole;

support means mounting and supporting said anchor base;

a blockage plug detachably and threadably engagable with said anchor base within said receptacle in the absence of said pole;

said receptacle is open-ended and said selected end includes external threads and said receptacle includes internal threads;

said support means provided with a flat surface engagable with said selected end of said pole so as to transfer loads from said elongated pole into said support means;

said support means is chosen from:

a. cement block;
b. concrete slab;
c. ground earth;
d. wood planking;

reinforcement means interconnecting said anchor base with said support means;

said reinforcement means is chosen from:

a. screws;
b. reinforcement rods;

said anchor base includes at least two recesses adjacent to said threaded receptacle; and holes extending at an angle from each of said recesses to said supporting means for insertably receiving at least a pair of fasteners.

* * * * *